United States Patent [19]

Nakamura

[11] 4,408,176

[45] Oct. 4, 1983

[54] FLYBACK TRANSFORMER

[75] Inventor: Kengi Nakamura, Katano, Japan

[73] Assignee: Sanyo Electric Co., Ltd., Osaka, Japan

[21] Appl. No.: 242,986

[22] Filed: Mar. 12, 1981

[30] Foreign Application Priority Data

Mar. 12, 1980 [JP] Japan ..... 55-32952[U]

[51] Int. Cl.[3] ..... H01F 27/04

[52] U.S. Cl. ..... 336/107; 174/52 PE; 336/96; 336/192; 336/198; 336/208

[58] Field of Search ..... 336/96, 192, 107, 198, 336/208; 174/52 PE; 338/273, 274

[56] References Cited

U.S. PATENT DOCUMENTS

| | | | |
|---|---|---|---|
| 3,462,645 | 8/1969 | Leonard | 336/107 |
| 3,860,320 | 1/1975 | Danner | 339/100 |
| 4,013,333 | 3/1977 | Chang | 339/98 |
| 4,050,772 | 9/1977 | Birnholz et al. | 339/220 R |
| 4,204,263 | 5/1980 | Onoue | 336/185 |
| 4,232,284 | 11/1980 | Phelon et al. | 336/192 |
| 4,246,636 | 1/1981 | Kawamura et al. | 336/96 |
| 4,247,889 | 1/1981 | Riechmann | 336/185 |

FOREIGN PATENT DOCUMENTS

| | | |
|---|---|---|
| 54-92388 | 6/1979 | Japan . |
| 54-99086 | 7/1979 | Japan . |
| 54-121287 | 8/1979 | Japan . |

*Primary Examiner*—A. T. Grimley
*Assistant Examiner*—Susan Steward
*Attorney, Agent, or Firm*—Armstrong, Nikaido, Marmelstein & Kubovcik

[57] ABSTRACT

A flyback transformer includes a casing and a coil-block accommodated in the casing. The casing has a guide opening communicating between inside and outside of the casing. The coil-block has a tongue portion which is formed with an opening. A cap member made of brass is supported in the opening of the tongue portion with an opening of the cap member being in alignment with the guide opening. The outside of the cap member is electrically connected to a wire extending from the coil-block and inside the cap member fittingly receives a lead wire which has been inserted into the casing through said guide opening.

13 Claims, 8 Drawing Figures

FLYBACK TRANSFORMER

BACKGROUND OF THE INVENTION

The present invention relates to a flyback transformer for use in a television receiver, and more particularly, to an improvement of assembly of the flyback transformer.

Generally, the flyback transformer has a coil-block formed by a series of coils wound on a bobbin and a casing for receiving the coil-block. After receiving the coil-block, the casing is filled with a cast-in material, such as epoxy resin, to prevent the coil-block from being undesirably shifted in the casing, and also to prevent the coil wound on the bobbin from being incurred by moisture or deleterious gas. The flyback transformer further has a lead wire extending outwardly from the casing for taking out a high voltage signal produced from one of the coils wound on the bobbin. Therefore, before the casing is filled with the cast-in material, the end of the lead wire located inside the casing must be connected to the end of the coil directly or through a high voltage rectifying diode.

If such a connection is carried out by means of soldering at the beginning of the manufacturing steps, the lead wire connected to the coil-block reduces the workability of the coil-block, resulting in decrease of efficiency of manufacturing process, or resulting in undesirable disconnection of the lead wire from the coil during the manufacturing process.

In order to avoid such a disadvantage, a set of pin and socket is employed for the easy but rigid connection between the end of the diode and lead wire. More particularly, as shown in FIG. 1, the pin 2 having a flange is soldered to the free end of the diode, and the socket 1 having one end portion 5 clamping the inner insulating tube 6 is soldered to the core wire of the lead wire 3. Then, after the coil-block is installed in the casing with the cast-in material being injected into the casing, the pin 2 is plugged into the socket 1. Thereafter, the cast-in material is further injected to conceal the pin and socket for securing the rigid connection therebetween.

The employment of the pin and socket, however, has such a disadvantage that a play portion of the wire extending from each of the pin and socket must be sufficiently long to facilitate the insertion of pin into the socket. Furthermore, since two additional parts, i.e., pin and socket, are required, manufacturing steps and material are increased, resulting in increase of the manufacturing cost.

SUMMARY OF THE INVENTION

Accordingly, it is a primary object of the present invention to provide a flyback transformer having a simple connecting means between the coil and lead wire provided for taking out the high voltage signal produced from the coil.

It is another object of the present invention to provide a flyback transformer of the above described type which can be readily manufactured at low cost.

In accomplishing these and other objects, a flyback transformer according to the present invention comprises a casing having a chamber formed therein and at least one guide opening that communicates from the chamber to the outside of the casing and a coil-block housed in the chamber of the casing. The coil-block comprises at least one bobbin wound with a series of coils and having a tongue portion extending from the bobbin. The tongue portion has an opening defined therein which is in alignment with the guide opening. A cap member made of an electrically conductive material is inserted into the opening of the tongue portion. The cap member has a body portion defining a bore which is opened at one end of the cap member. The open end of the bore is facing the guide opening. The coil-block further comprises an electrical connecting means for connecting the cap member and one end of the coils. The flyback transformer further comprises a lead wire having one end portion inserted into the bore through the guide opening for effecting an electric connection between the lead wire and the coil, and the other end portion extending outwardly from the casing, and a cast-in material injected into the casing.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE PREFERRED EMBODIMENT

Figure 2:
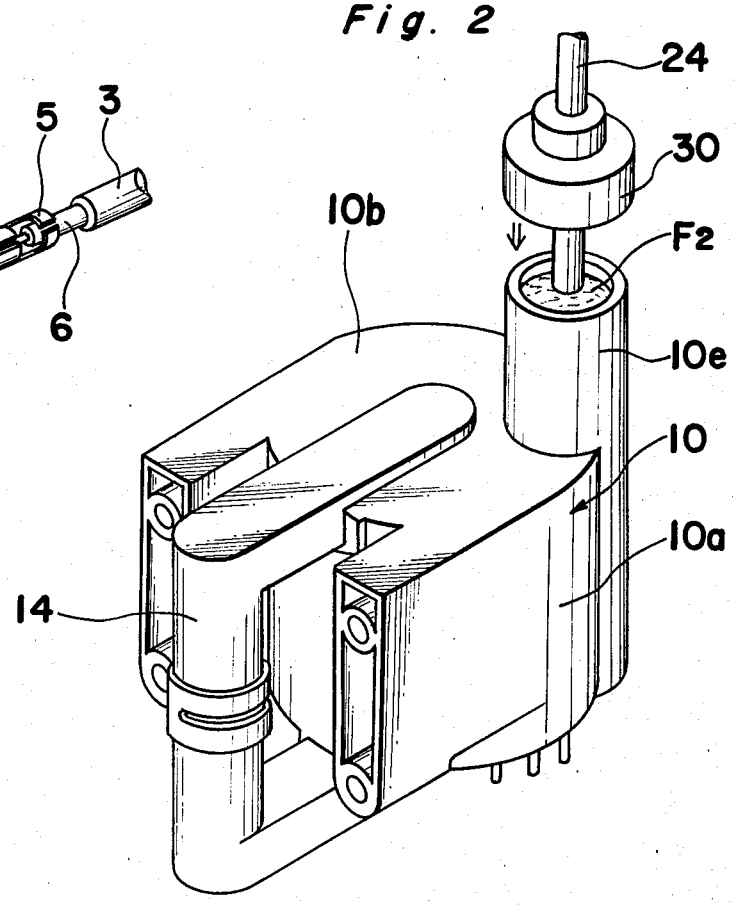
FIG. 2 is a perspective view of a flyback transformer according to the present invention.
Figure 3:
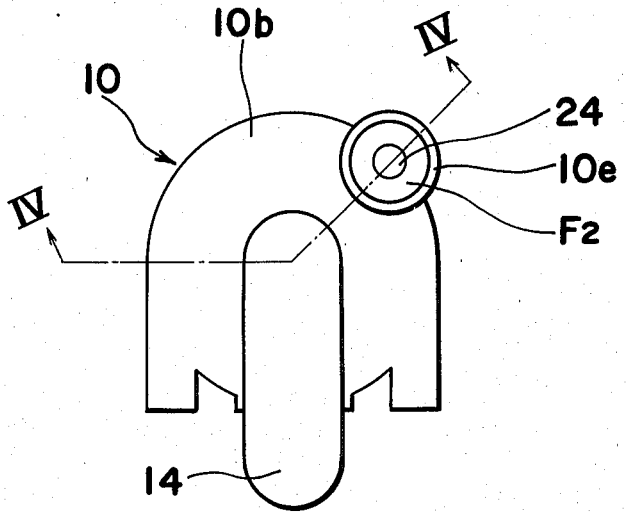
FIG. 3 is a top plan view of the flyback transformer of FIG. 2.
Figure 4:
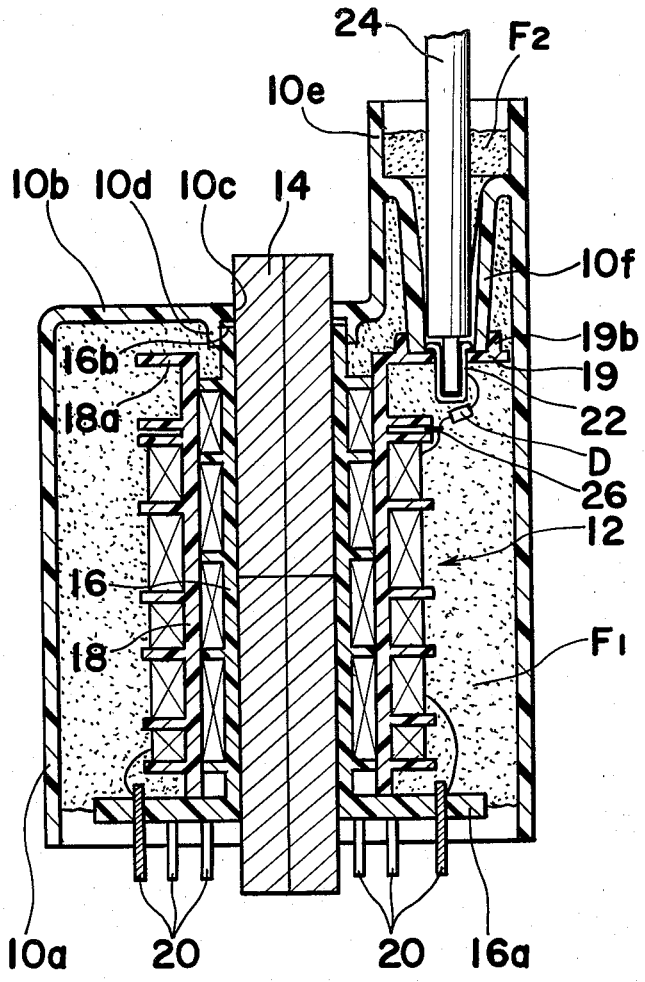
FIG. 4 is a cross-sectional view taken along a line IV—IV shown in FIG. 3.

Referring to FIGS. 2, 3 and 4, a flyback transformer according to the present invention comprises a casing 10 made of synthetic resin, for example, phenylene oxide, or "Noryl" which is a product of Engineering Plastics, Ltd., a coil block 12 (FIG. 4) housed in the casing 10 and a core 14 having a portion that extends through the coil block 12 and a portion that is located outside the casing 10 for establishing a closed magnetic circuit.

The casing 10 has a cylindrical body portion **10*a* forming a chamber therein. The chamber is opened at the bottom of the casing 10 and is partly closed at the top of the casing 10. More particularly, the top of the casing 10, when viewed in FIG. 2 or 4, is formed with a lid plate 10*b* which is formed with a circle opening 10*c* approximately at the center of the lid plate 10*b* for the insertion of the core 14. On the inside surface of the lid plate 10*b*, an annular wall 10*d* (FIG. 4) is provided coaxially around the opening 10*c* for the fitting engagement with the coil block 12 in a manner described later. The casing 10 further has a guide opening, or small cylindrical body portion, 10*e* that extends upwardly from a peripheral portion of the lid plate 10*b* in a manner of chimney. Inside the small cylindrical body portion 10*e* and below the upper edge of the small cylindrical body portion 10*e***, there is provided a funnel portion 10*f* which is tapered downwardly towards the chamber of the casing 10.

The coil block 12 includes an inner bobbin 16 and an outer bobbin 18 coaxially mounted on the inner bobbin 16. The inner and outer bobbins 16 and 18 are made of synthetic resin, for example, phenylene oxide or "Noryl" mentioned above. The inner bobbin 16 has a bore formed therethrough for receiving therein the core 14 and a flange 16*a* at the bottom thereof for holding a plurality of pins 20 made of electric conductive material. The upper end 16*b* of the inner bobbin 16 is rigidly inserted into the annular wall 10*d* for the temporary support of the coil block 12. The intermediate portion of the inner bobbin 16 is wound with a series of coils which are connected to the pins 20. For facilitating the winding of the coils, the intermediate portion of the bobbin 16 is formed with a plurality of flanges. The outer bobbin 18 has a bottom end supported on the flange 16*a* of the inner bobbin 16, an intermediate portion wound with a series of coils and a flange 18*a* provided at the upper end of the outer bobbin 18. The coils wound on the intermediate portion of the outer bobbin 18 are separated from each other by flanges mounted on the inner bobbin 18 and are connected to pins 20 and also to a cap member 22 in a manner described later for the connection to a lead wire 24 which extends outwardly from the flyback transformer to a cathode ray tube (not shown) of a television receiver set.

Figure 5:
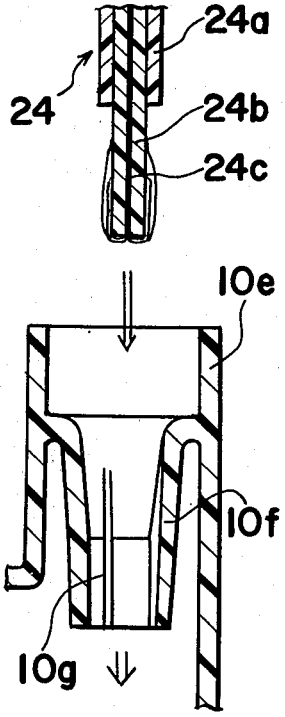
FIG. 5 is an exploded view of a part of the flyback transformer of FIG. 4, particularly showing an assembly for the connection of a lead wire.
Figure 7:
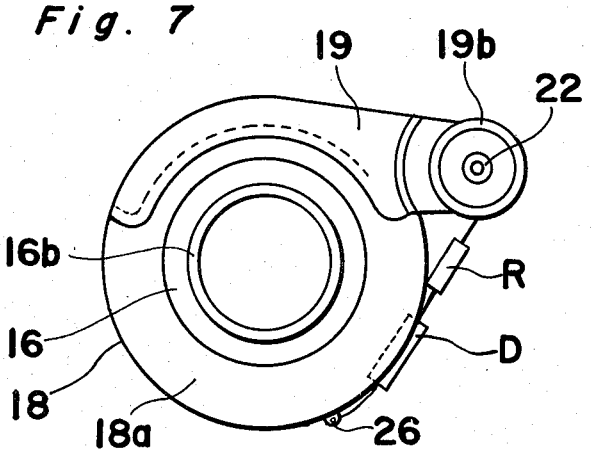
FIG. 7 is a top plan view of a coil-block employed in the flyback transformer of FIG. 4.

The flange 18*a* of the outer bobbin 18 is formed with a tongue portion 19 which extends outwardly from the flange 18*a*, as best shown in FIG. 7. The end portion of the tongue 19 remote from the flange 18*a* is formed with a circle opening 19*a* (FIG. 5) in which the cylindrical cap member 22 is forcibly inserted. For this purpose, the circle opening 19*a* is tapered towards its bottom end, when viewed in FIG. 5, such that the inner diameter of the circle opening 19*a* is slightly greater than the outer diameter of the cylindrical cap member 22 at the upper edge of the opening 19*a*, and is slightly smaller than the same at the lower edge of the opening 19*a*. The cap member 22 made of electrically conductive material, such as brass, has a cylindrical body formed with a chamber therein. The upper end of the cap member 22 is opened and formed with a flange 22*a* for the engagement with the upper edge of the opening 19*a* and the bottom end of the cap member 22 is closed by a rounded end wall 22*b*. The length of the cap member 22 measured in its axial direction is greater than the thickness of the tongue 19 so that when the cap member 22 is inserted into the opening 19*a* of the tongue 19, the lower end portion of the cap member 22 projects downwardly from the tongue 19. According to the preferred embodiment, the cap member 22 is slightly tapered towards its closed end for facilitating its insertion into the opening 19*a* and also for ensuring the electrical contact between the inner wall of the cap member 22 and a stripped end of the lead wire 24 which is to be inserted into the cap member 22. Since the degree of tapering of the cap member 22 is much less than that of the opening 19*a*, the lower edge of the opening 19*a* tightly holds the cap member 22. An annular wall 19*b* is coaxially provided around the circle opening 19*a* for fittingly receiving therein the lower tapered end of the funnel portion 10*f*.

For the connection between the end of the coil that produces a high voltage signal for the cathode ray tube (not shown) and the outer surface of the cap member 22 projecting downwardly from the tongue 19, the end of the coil is first soldered to a metallic segment 26 (FIG. 4) which is fittingly inserted into a recess formed in the outer bobbin 18. The metallic segment 26 is then, in turn, connected through a suitable lead wire to the outer surface of the cap member 22 such that one end of the lead wire is connected to the metallic segment 26 by the deposition of solder bead and the other end is wound around the cap member 22 and connected thereto by the deposition of solder bead. The intermediate portion of the lead wire should preferably extend along the perimeter of the coil. Instead of soldering, the connection can be carried out by any known method, such as sputtering. In place of the lead wire, it is possible to employ an electric element, such as diode D or resistor R, solely or in series connection, as diagrammatically shown in FIGS. 4 and 7. Since the segment 26 is employed, the connection between the coil formed by a very thin wire and the lead wire, or electric element, can be carried out without difficulty.

When the coil-block 12 is assembled in a manner described above with a suitable connecting means extending between the coil and the cap member 22, the coil-block 12 is accommodated in the chamber of the casing 10 in such a manner that the upper end 16*b* of the inner bobbin 16 is forcibly inserted into the annular wall 10*d* of the casing 10 and, at the same time, the lower end of the funnel portion 10*f* is forcibly inserted into the annular wall 19*b* mounted on the tongue portion 19 for temporarily holding the coil-block 12 inside the casing 10. Thereafter the chamber of the casing 10 is injected with cast-in material F1 from the open end of the casing 10. According to the preferred embodiment, the cast-in material F1 is thermosetting epoxy resin such as, NX1065 in combination with NX1066 which are products of CIBA-GEIGY (JAPAN) Ltd., or K-550A in combination with K-550B which are products of Somar Mfg. Co. Ltd. These resins are particularly suitable for obtaining a high electrical insulation for the coils wound on the outer bobbin 18 and a high bonding effect between the coil-block 12 and the casing 10. When the epoxy resin F1 filled in the casing solidifies, the stripped lead wire 24 is forcibly inserted into the cap member 22 through the small cylindrical body portion 10*e* guided by the funnel 10*f*. According to the embodiment shown, the lead wire 24 (FIG. 5) is constituted by an outer insulating tube 24*a* formed by vinyl chloride, inner insulating tube 24*b* formed by polyethylene and a bundle of lead lines 24*c* carried in the inner insulating tube 24*b*. The outer and inner insulating tubes 24*a* and 24*b* are stripped to expose the lead lines 24*c* for a length shorter than the length of the cap member 22. Then, the outer insulating tube 24*a* is further stripped to expose the inner insulating tube 24*b* for a length slightly longer than the length of the cap member 22. Thereafter, the lead lines 24*c* are bent backwards about the edge of the inner insulating tube 24*b* in a manner shown in FIG. 5, so that the lead lines 24*c* lie on the inner insulating tube 24*b*. When thus stripped lead wire 24 is inserted into the cap member 22, the lead lines 24*c* tightly contacts with the inner wall of the cap member 22 resulting in electric connection between the cap member 22 and the lead wire 24.

After the lead wire 24 is inserted into the cap member 22 in the above described manner, a space in the small cylindrical body portion 10*e* defined between the outer surface of the lead wire 24 and inner surface of the small cylindrical body portion 10*e* and the funnel portion 10*f*, is injected with a cast-in material F2 from the opened top end of the small cylindrical body portion 10*e*. According to the preferred embodiment, the cast-in material F2 is cold-setting epoxy resin, such as, 7912-3A in combination with 7912-3B which are products of Somar Mfg. Co. Ltd. These resins are particularly suitable for obtaining a high bonding effect between the small cylindrical body portion 10*e* and the lead wire 24. Thereafter, the core 14 is applied in a known manner to complete the flyback transformer of the present invention.

Figure 6:
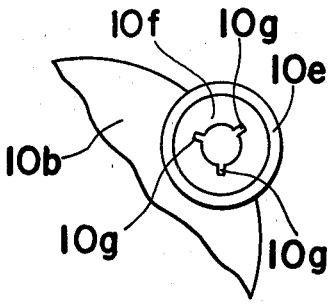
FIG. 6 is a partial top plan view of the flyback transformer before the insertion of the lead wire.

According to the preferred embodiment, the inner surface of the funnel portion 10*f* is formed with one or more grooves 10*g* (FIGS. 5 and 6) that extends in a direction parallel to the axis of the small cylinder body portion 10*e* so as to allow the injection of molten resin through the groove 10*g* into the cap member 22. The injected resin in the cap member 22 prevents the lead lines 24*c* inside the cap member 22 from producing undesirable spark discharge.

Furthermore, according to the preferred embodiment, a rubber cap member 30, as shown in FIG. 2, is mounted on the open end of the small cylindrical body portion 10*e*.

Figure 8:
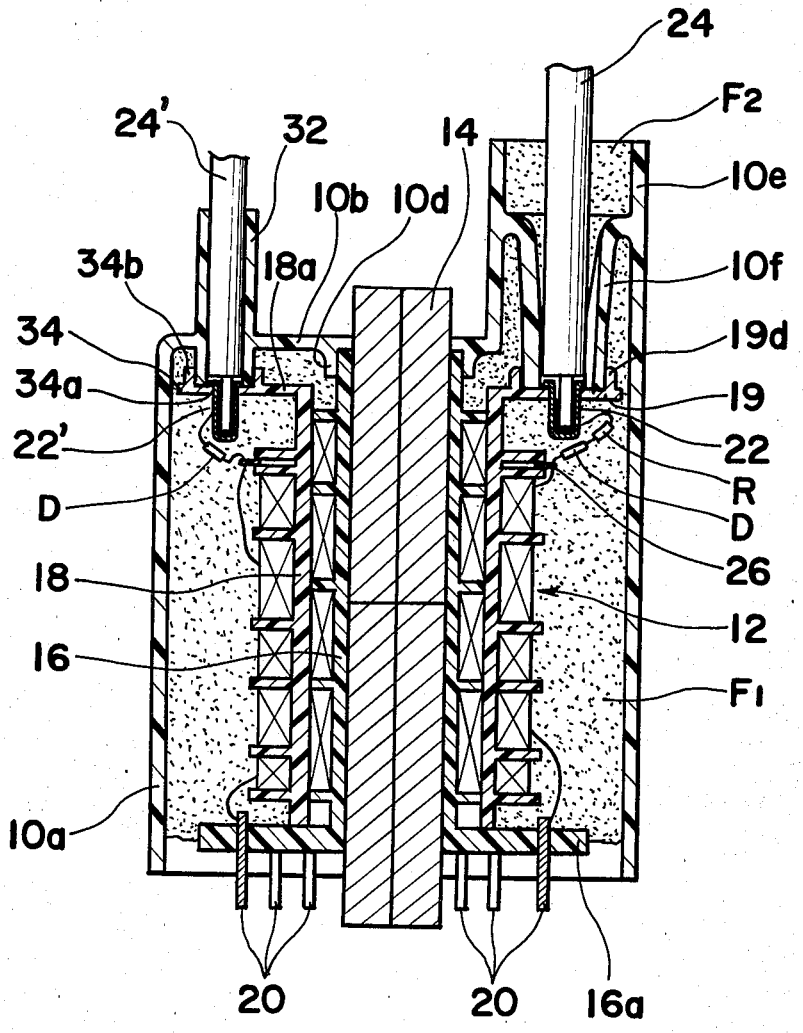
FIG. 8 is a view similar to FIG. 4 but particularly showing a modification thereof.

Referring to FIG. 8, there is shown a modification of the flyback transformer of the present invention. The flyback transformer shown in FIG. 8 further includes another guide opening, or small cylindrical body portion 32 extending upwardly and downwardly from a peripheral portion of the lid plate 10*b* in a manner of chimney. The lower end of the small cylindrical body portion 32 located inside the chamber is fittingly engaged with an annular wall 34*b* formed on a tongue 34 extending from the flange 18*a* of the outer bobbin 18. The tongue 34 is formed with an opening 34*a* in a coaxial relation with the annular wall 34*b* for receiving therein the cap member 22' which is electrically connected through a lead wire or suitable electric element to a coil wound on the outer bobbin 18. The coil to be connected to the cap member 22' produces a high voltage signal for the control of focus. Since the inner diameter of the small cylindrical body portion 32 is approximately equal to the outer diameter of the lead wire 24', the cylindrical body portion 32 fittingly receives the lead wire 24'. Therefore, in the arrangement of flyback transformer of FIG. 8, it is not necessary to provide any resin or the like between the lead wire 24' and small cylindrical body portion 32. Instead, it is preferable to provide a rubber cap (not shown) on the small cylindrical body portion 32 in a manner similar to that provided on the small cylindrical body portion 10*e*.

When the flyback transformer of the present invention is completed, the lead lines 24*c* of the lead wire 24 and the cap member 22 are maintained in a rigid connection mechanically and electrically by the solidified cast-in material F2. Also, the mechanical and electrical connection between the electric element, such as diode, and the cap member 22 effected by the soldering, or the like, is found to be durable for a long-term by the reinforcement of the solidified cast-in material F1.

Figure 1:
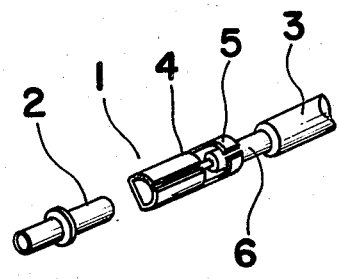
Fig. 1 PRIOR ART
FIG. 1 is a perspective view showing an arrangement of pin and socket employed in the flyback transformer of the prior art.

Since the flyback transformer of the present invention can connect the lead wire 24 with a coil directly or through electric element with less parts when compared with the flyback transformer of the prior art explained above in connection with FIG. 1, the manufacturing steps and manufacturing cost are reduced.

Furthermore, since the joint between the lead wire 24 and the cap member 22 and the joint between the cap member 22 and the electric element are formed without occupying a comparatively large surface and without having any pointing portion, the high voltage signal from the coil can be transmitted to the lead wire 24 with high reliability and without producing any undesirable spark discharge.

Moreover, since the lead wire 24 is not connected to the coil wound on the outer bobbin 18 during the manufacture of the coil-block 12, the coil-block 12 can be handled with high efficiency, resulting in less happening of accidents, thus resulting in the increase of reliability of flyback transformer.

As various changes could be made in the above constructions without departing from the scope of the invention, it is intended that all matter contained in the above description or shown in the accompanying drawings shall be interpreted as illustrative and not in a limited sense.

What is claimed is:

1. A electrical connecting apparatus for use in effecting an electrical connection between an electrical device positioned within a casing and a lead wire extending from said casing, said electrical connecting apparatus comprising:

a chamber formed within a casing, said device being positioned within said casing, said casing having at least one guide opening that communicates from the chamber to the outside of said casing;

a tongue portion extending from said device, said tongue portion having an opening defined therein, said opening being in alignment with said guide opening;

a cap member made of an electrically conductive material and having a body portion and a bore defined therein, one end of said bore being opened, said cap member being inserted into said opening of said tongue portion with said open end of said bore facing said guide opening;

electrical connecting means for connecting said cap member and said device;

wherein a lead wire extending from the casing has one end portion inserted into said bore through said guide opening for effecting an electric connection between said lead wire and said device, and the other end portion of said lead wire extending outwardly from the casing; and a cast-in material injected into said chamber.

2. A flyback transformer comprising:

a casing having a chamber formed therein and at least one guide opening that communicates from the chamber to the outside of said casing;

a coil-block housed in said chamber of said casing, said coil-block comprising:

(i) at least one bobbin having a tongue portion extending from said bobbin, said tongue portion having an opening defined therein, said opening being in alignment with said guide opening;

(ii) a series of coils wound on said bobbin;

(iii) a cap member made of an electrically conductive material having a body portion and a bore defined therein, one end of said bore being opened, said cap member inserted into said opening of said tongue portion with said open end of said bore facing said guide opening; and (iv) electrical connecting means for connecting said cap member and one of said coils;

lead wire having one end portion inserted into said bore through said guide opening for effecting an electric connection between said lead wire and said coil, and the other end portion of said lead wire extending outwardly from the casing; and a first cast-in material injected into said chamber.

3. A flyback transformer as claimed in claim 2, wherein said casing further comprises a funnel portion formed in said guide opening such that a tapered end of said funnel portion directs the chamber of said casing, thereby guiding said lead wire through said funnel portion.

4. A flyback transformer as claimed in claim 3, wherein said tongue portion has an annular wall formed coaxially around said opening, said annular wall fittingly engages with tapered end of said funnel portion for substantially closing said guide opening.

5. A flyback transformer as claimed in claim 4, further comprising a second cast-in material injected into said funnel portion through said guide opening.

6. A flyback transformer as claimed in claim 5, wherein said funnel portion is formed with at least one groove formed on the inner surface thereof for the transmital of said second cast-in material into said bore.

7. A flyback transformer as claimed in claim 2, wherein said opening formed in said tongue portion is tapered in thickness direction of said tongue portion such that the diameter of said opening at a portion facing the guide opening is greater than the outer diameter of said cap member and the diameter of said opening at a portion remote from the guide opening is smaller than the outer diameter of said cap member.

8. A flyback transformer as claimed in claim 2, wherein said bore formed in said cap member is closed at the end opposite to said open end.

9. A flyback transformer as claimed in claim 8, wherein said cap member is tapered towards closed end.

10. A flyback transformer as claimed in claim 2, wherein said electrical connecting means is any one of resistor and diode.

11. A flyback transformer as claimed in claim 2, wherein said electrical connecting means is a series connection of resistor and diode.

12. A flyback transformer as claimed in claim 2, wherein said cap member has a flange at its open end.

13. A flyback transformer as claimed in claim 2, wherein said bobbin has a flange from which said tongue portion extends.

* * * * *